US009085857B2

(12) United States Patent
Held et al.

(10) Patent No.: US 9,085,857 B2
(45) Date of Patent: Jul. 21, 2015

(54) AUTOMOTIVE MILLING MACHINE, USE OF A LIFTING COLUMN OF A MILLING MACHINE, AS WELL AS METHOD FOR INCREASING THE OPERATING EFFICIENCY OF A MILLING MACHINE

(71) Applicant: Wirtgen GmbH, Windhagen (DE)

(72) Inventors: Hanjo Held, Windhagen (DE); Markus Schaefer, Asbach/Westerwald (DE); Christian Berning, Bruehl (DE); Cyrus Barimani, Koenigswinter (DE); Guenter Haehn, Koenigswinter (DE)

(73) Assignee: Wirtgen GmbH (DE)

( * ) Notice: Subject to any disclaimer, the term of this patent is extended or adjusted under 35 U.S.C. 154(b) by 13 days.

(21) Appl. No.: 13/827,409

(22) Filed: Mar. 14, 2013

(65) Prior Publication Data

US 2013/0257136 A1 Oct. 3, 2013

(30) Foreign Application Priority Data

Mar. 28, 2012 (DE) ..... 10 2012 205 005

(51) Int. Cl.
*E01C 23/088* (2006.01)
*E01C 23/12* (2006.01)

(52) U.S. Cl.
CPC ..... *E01C 23/127* (2013.01); *E01C 23/088* (2013.01)

(58) Field of Classification Search
CPC ..... E01C 23/127; B60G 1/04
USPC ..... 299/39.1, 39.4, 39.6, 39.7; 248/566
See application file for complete search history.

(56) References Cited

U.S. PATENT DOCUMENTS

| | | | | |
|---|---|---|---|---|
| 4,221,434 | A * | 9/1980 | Swisher et al. | 299/39.6 |
| 4,527,676 | A * | 7/1985 | Emura et al. | 188/266.4 |
| 4,929,121 | A * | 5/1990 | Lent et al. | 404/84.05 |
| 6,106,073 | A | 8/2000 | Simons et al. | |
| 7,828,309 | B2 * | 11/2010 | Berning et al. | 280/124.159 |
| 8,113,592 | B2 * | 2/2012 | Busley et al. | 299/39.6 |
| 2011/0268503 | A1 * | 11/2011 | Hall et al. | 404/90 |

FOREIGN PATENT DOCUMENTS

EP 0916004 B1 9/1999

* cited by examiner

*Primary Examiner* — David Bagnell
*Assistant Examiner* — Michael Goodwin
(74) *Attorney, Agent, or Firm* — Lucian Wayne Beavers; Patterson Intellectual Property Law, PC

(57) ABSTRACT

An automotive milling machine, for the treatment of road surfaces or ground surfaces includes a chassis comprising front and rear suspension axles with a total of no less than three suspension units with a machine frame supported by the chassis, with lifting columns between the suspension units and the machine frame at no less than two suspension units of a suspension axle, said suspension units being transversely offset from one another in the direction of travel, and with a working drum. The working drum is adjustable to a position for driving in travel mode with the working drum raised and, in the adjusted position of the working drum at a distance from the road surface or ground surface, the lifting columns are suitable for coupling to a spring device.

19 Claims, 3 Drawing Sheets

AUTOMOTIVE MILLING MACHINE, USE OF A LIFTING COLUMN OF A MILLING MACHINE, AS WELL AS METHOD FOR INCREASING THE OPERATING EFFICIENCY OF A MILLING MACHINE

BACKGROUND OF THE INVENTION

1. Field of the Invention

The invention relates to an automotive milling machine, in particular a road milling machine, a stabilizer, a recycler or a surface miner, for the treatment of road surfaces or ground surfaces, as well as to the use of lifting columns of a milling machine, and to a method for increasing the operating efficiency of a milling machine.

2. Description of the Prior Art

An automotive road milling machine is known, for example, from EP 0 916 004. The road milling machine described therein comprises a chassis with front and rear suspension axles as seen in the direction of travel, wherein each suspension axle comprises two suspension units that may be comprised of wheeled suspension units and/or tracked suspension units. It is also possible for one suspension axle, preferably the front one, to comprise a single suspension unit only in smaller machines. The chassis supports the machine frame via lifting columns at no less than two suspension units of a suspension axle. In EP 0 916 004, at least the rear suspension axle comprises lifting columns, with no less than one of the suspension units of the rear suspension axle being additionally pivotable into a retracted position for close-to-edge milling. In EP 0 916 004, the working drum is mounted between the rear suspension units as seen in the direction of travel. Alternatively, the working drum may be located between the front and rear suspension units or even behind the rear suspension units as seen in the direction of travel. The milling depth of the working drum can be altered by means of the lifting columns. It is understood that the working drum may also be height-adjustable independent of the machine frame. The operator's platform of the milling machine is located above the rear suspension axle. The operator's platform may also be intended in a different position on the machine frame, for example, between the suspension axles or behind the rear suspension axle as seen in the direction of travel. According to a further alternative, the milling machine may also be designed without an operator's platform, in which case the milling machine is operated by a machine operator via remote control.

With such automotive milling machines, it is often necessary, in particular during the repair of road surfaces or ground surfaces, to perform the milling operation for a short travel distance only and then to reposition the machine to a different operating site, in which case an extended travel distance must be covered without performing a milling operation. When doing so, the design of the milling machines usually allows a low travel speed of approx. 5 km/h only, as the vibrations generated in travel mode can damage the mechanical components of the milling machine or can at least reduce the service life of the same. In addition, said vibrations are also unpleasant for a machine operator. Due to the slow speed during repositioning of the milling machine to a new operating site, the operating efficiency of the milling machine is limited.

SUMMARY OF THE INVENTION

It is therefore the object of the invention to increase the operating efficiency of a milling machine first mentioned above, as well as to specify a method for increasing the operating efficiency of a milling machine.

The invention provides in an advantageous fashion for the working drum to be adjustable to a position for driving in travel mode with the working drum raised and, in the adjusted position, for the lifting columns to be suitable for coupling to a spring device.

The invention advantageously provides, for driving in travel mode with the working drum raised, for the lifting columns to be coupled to a spring device, in this way enabling a spring device to act between the machine frame and the lifting columns. This is to say that the lifting columns, which were previously only used for height adjustment of the machine frame, are modified in their design in such a way as to enable a spring action in lieu of the height adjustment.

The modification in design of the lifting columns can be accomplished in an inexpensive and space-saving fashion, wherein the spring device is also integrable into the lifting column. The invention creates a new functionality for the lifting columns without increased space requirement and without requiring a great design-related or equipment-related effort. The lifting columns enable a spring action in such a way that the milling machine, when driving in travel mode only without engagement of the working drum, can be moved at a considerably higher travel speed without the machine and the machine operator being exposed to increased stress and strain. The milling machine can be moved at a much higher than the previously possible maximum travel speed so that significant time savings result when repositioning the milling machine to a different operating site, which markedly increases the milling machine's operating efficiency.

The spring device may be a mechanical or a hydraulic spring device. In the event of a mechanical spring device, the same is arranged between the suspension unit and the machine frame in line with the lifting column, with the spring device being mechanically blocked when the working drum performs a milling operation. In the event of a hydraulic spring device, the same is locked hydraulically when the working drum performs a milling operation.

The lifting column preferably comprises a hydraulic piston-cylinder unit that contains a piston movable inside a cylinder, said piston dividing the cylinder of the piston-cylinder unit into an upper cylinder chamber and a lower cylinder chamber. In this arrangement, the cylinder is rigidly attached to the machine frame while the piston is rigidly attached to the suspension unit.

In a preferred further development of the invention, it is intended for the cylinder chambers to be suitable for coupling to the hydraulic spring device via no less than one controllable valve. Such hydraulic circuit enables the lifting columns to be used for cushioning the machine frame.

The spring device preferably comprises a diaphragm accumulator. For spring operation, such diaphragm accumulator is connected to the cylinder chambers of the piston-cylinder unit of the lifting column.

It is preferably intended for the no less than one controllable valve to be closed in working mode and to be opened in travel mode with no operation of the working drum once a pre-determinable height of lift of the lifting column has been reached. In this arrangement, coupling to the spring device may also be effected automatically upon reaching a pre-adjusted height of lift of the lifting columns.

In one embodiment, it is intended for the rear lifting columns as seen in the direction of travel to be suitable for coupling to the no less than one spring device.

The lifting columns may each be suitable for coupling to one or several spring devices. As an alternative option, all lifting columns may be suitable for coupling to no less than one common spring device.

The lifting columns known from automotive milling machines can be used to cushion any shocks which occur during repositioning of the milling machine in travel mode, when the working drum is disengaged, by coupling the lifting column to a spring device. The piston-cylinder unit used for height adjustment can be used for spring action by alternatively coupling the cylinder chambers, via no less than one controllable valve, to a hydraulic spring device.

A method for increasing the operating efficiency of a milling machine with a working drum is characterized by the following steps:

- Raising the working drum to a position in which it is disengaged from the road surface or ground surface;
- Coupling the lifting columns to no less than one spring device for driving in travel mode without engagement of the working drum;
- Repositioning the milling machine to a different operating site at an increased travel speed in travel mode without engagement of the working drum; and
- Locking the coupling of the lifting columns to the spring device for driving in working mode with engagement of the working drum after having reached the new operating site.

BRIEF DESCRIPTION OF THE DRAWINGS

In the following, embodiments of the invention are explained in more detail with reference to the drawings.

The following is shown.

DETAILED DESCRIPTION

Figure 1:
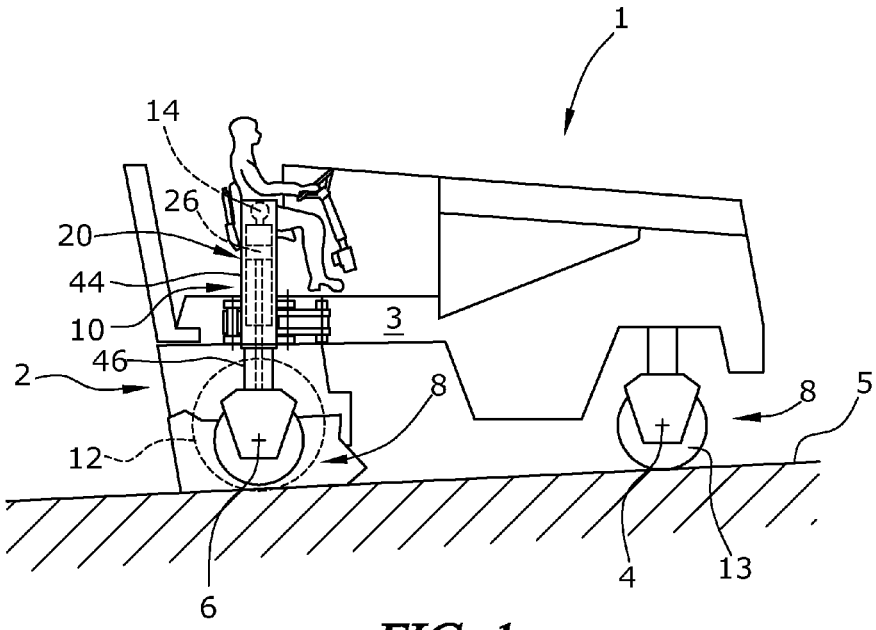
FIG. 1 a schematically illustrated road milling machine.

The automotive milling machine shown in FIG. 1 is a road milling machine 1 with a machine frame 3 which is supported by a chassis 2 comprising front and rear suspension axles 4,6 as seen in the direction of travel 18 with a total of no less than three suspension units 8. The suspension units 8 may be wheeled suspension units 13 or tracked suspension units, where wheeled suspension units 13 and tracked suspension units may be present together. The front suspension units 8 are steerable. The rear suspension units 8 may also be steerable. The suspension units 8 may also be referred to as ground engaging units or as running gears or as travelling drive units.

A working drum 12 is supported by the machine frame 3 where, with the working drum 12 being rigidly mounted in the machine frame 3, the milling depth can be adjusted by means of lifting columns 10. If the working drum 12 is itself mounted in the machine frame 3 in a height-adjustable fashion, the lifting columns only serve to adjust the distance of the machine frame 3 from the road surface or ground surface 5. In raised position of the working drum 12, the same has a distance from the road surface or ground surface 5 allowing deflection of the chassis 2 without the working drum 12 being damaged.

Figure 2:
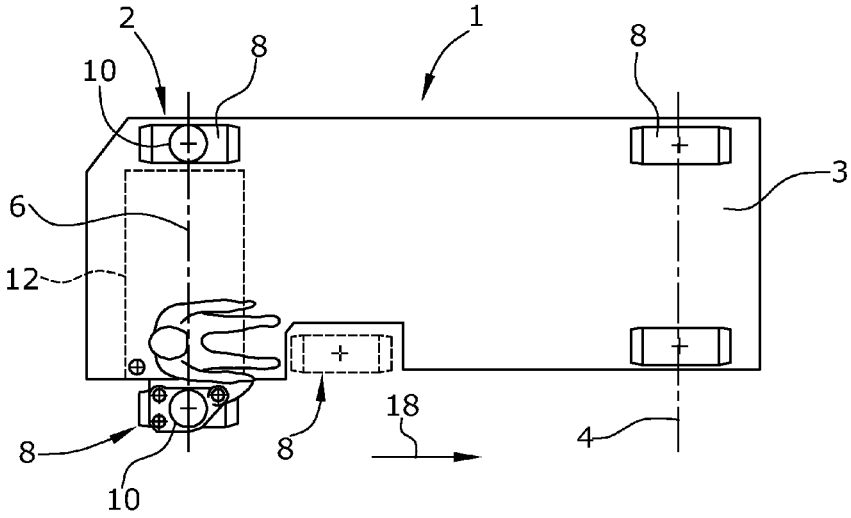
FIG. 2 a top view of the road milling machine.

In the embodiment shown, lifting columns 10 are intended at the rear suspension axle 6 only. FIG. 1 shows the position of the suspension unit 8 in normal mode. The suspension unit 8 can be pivoted to a position within the contours of the machine frame 3 for close-to-edge milling, as can be inferred from FIG. 2. In this case, it is possible to mill close up to an obstacle with the front end of the working drum 12. The pivotable suspension unit 8 may be steerable in particular when in pivoted-in position.

In other embodiments of an automotive milling machine, the working drum 12 may also be arranged between the suspension axles 4,6 or even behind the rear suspension axle 6 as seen in the direction of travel.

It is understood that it is also possible for all suspension units 8 to be provided with lifting columns 10.

The lifting column 10 comprises two tubes which are adjustable telescopically inside one another, where the outer tube 44 is attached to the machine frame 3 and the inner tube 46 is attached to the suspension unit 8. The inner tube 46 can slide inside the outer tube 44 telescopically almost without play and may be secured against torsion. A piston-cylinder unit 20 is arranged inside the lifting column 10, the cylinder 25 of which is connected to the outer tube 44 and the piston 26 of which is attached to the suspension unit 8. When operating the piston-cylinder unit 20, height adjustment of the machine frame 3 can be effected by moving the outer tube 44, which is connected to the machine frame 3, relative to the inner tube 46 and the suspension unit 8.

Figure 3:
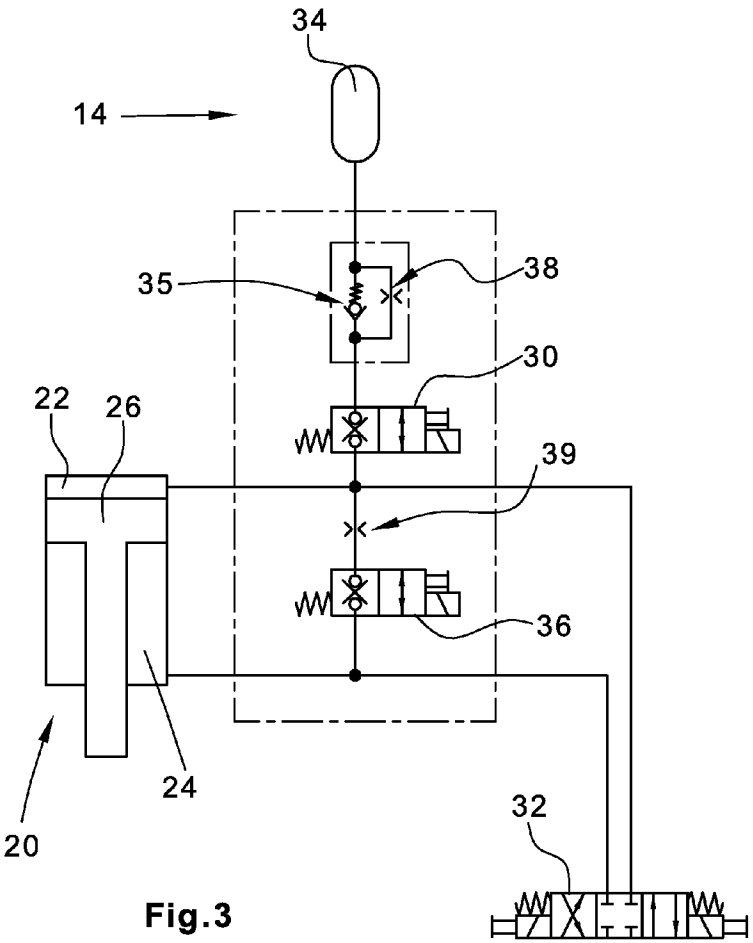
FIG. 3 a first embodiment of a spring device.

FIG. 3 shows the hydraulic circuit diagram for coupling the piston-cylinder unit 20 to a spring device 14 or a spring/damping device 14 respectively.

First, the normal operation of the lifting column 10 will be described. To this end, the milling machine has, on its control panel, a height-adjustment valve 32 which can be used to height-adjust the lifting column 10. The height-adjustment valve 32 is a 4/3-way directional valve so that, depending on the switching position of the height-adjustment valve 32, the upper cylinder chamber 22 can be pressurized and the lower cylinder chamber 24 can be relieved from pressure, or vice versa. In the first case, the lifting column 10 is raised; in the second case, it is lowered. When the height-adjustment valve 32 is in neutral position, the lines leading to the cylinder chambers 22 and 24 are locked so that the lifting column 10 is arrested in its position. The milling operation is carried out in said neutral position. It is vital for the chassis to be absolutely rigid during the milling operation and to not allow any spring action to take place. All lifting columns 10 are therefore fully arrested so that the milling depth can be adhered to exact to the millimeter despite the milling machine weighing several tonnes.

Now, when a travel mode with the working drum 12 raised is to be initiated after the working drum 12 has been brought into a raised position by an own height adjustment device or by the lifting columns 10, the cylinder chambers 22,24 can be connected to a diaphragm accumulator 34 when the simultaneously switched valves 30,36 are open. Owing to the compressive elasticity of the diaphragm accumulator 34, the pressure inside the cylinder chambers 22,24 can now vary so as to enable a spring action. The diaphragm accumulator 34 has sufficient operating pressure to support the machine weight on the one hand while allowing a certain oscillation of the piston 26 inside the piston-cylinder unit 20 on the other. The line leading to the diaphragm accumulator 34 is locked, in the direction of the return flow, by a non-return valve 35 that is bridged by a throttle 38 so that depressurization in the diaphragm accumulator 34 is slowed via the throttle 38. For this reason, the spring device 14 also has damping properties meaning that a spring/damping device has been formed.

The second switching valve 36 is also provided with a throttle 39 which, in the open position of the switching valve 36, prevents an abrupt equalization of pressure between the cylinder chambers 22 and 24.

The switching valve 36 is connected between the hydraulic pressure lines leading to the cylinder chambers 22 and 24, thus bridging the hydraulic pressure lines leading from the height-adjustment valve 32 to the piston-cylinder unit 20. The hydraulic pressure line leading to the diaphragm accumulator 34 branches off from one of the hydraulic pressure lines leading to the cylinder chambers 22,24. When in open position, the switching valves 30,36 release the flow of pressure simultaneously, while locking the flow in both directions when in closed position. The simultaneously switched double valve 30,36 enables the function of the lifting columns 10 to be changed from height adjustment to spring action and vice versa.

If driving in travel mode is terminated, and if a working mode with engagement of the working drum 12 is to be initiated, the simultaneously switched double valve 30,36 is transferred into its closed position, whereupon the lifting columns 10 can be operated in the usual way by means of the height-adjustment valve 32 as necessary.

The double valve 30,36, the non-return valve 35 and the throttle 38 may form one constructional unit. As can be inferred from FIG. 1, said constructional unit may be arranged inside the outer tube 44 of the lifting column 10.

Figure 4:
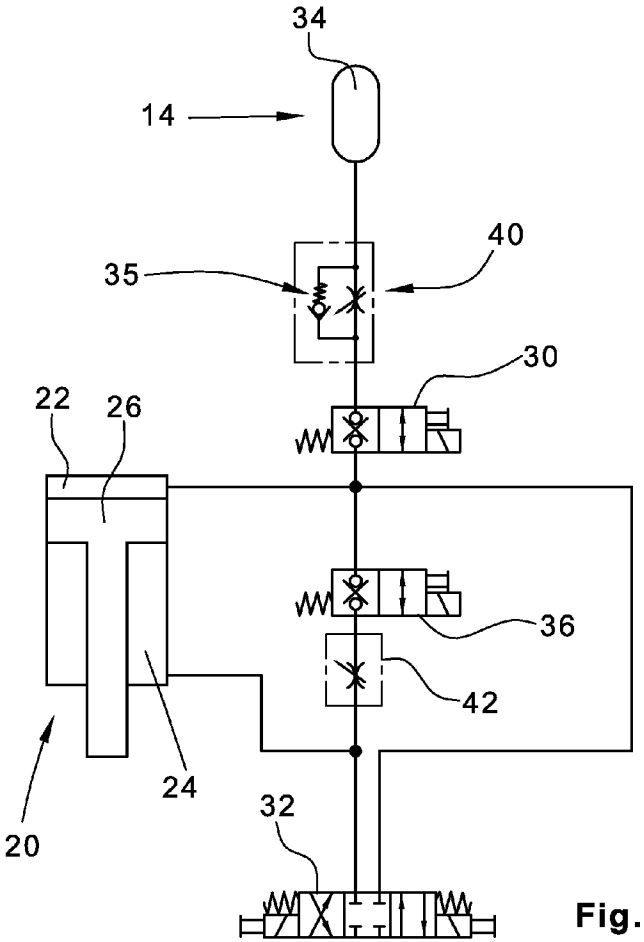
FIG. 4 a second embodiment of a spring device.

FIG. 4 shows an additional embodiment that is different from the embodiment in FIG. 3 only in that throttling is now adjustable in a variable fashion as can be inferred from FIG. 4 by reference to the adjustable throttles 40,42. The adjustable throttles 40,42 enable the damping properties to be adapted to the local conditions of the road surfaces or ground surfaces or to the desired riding comfort respectively.

Coupling the lifting columns 10 to a spring device 14 or a spring/damping device respectively enables the lifting columns 10 themselves to be converted into a spring system so that, because of the now resulting spring and damping properties, higher travel speeds exceeding, for example, 12 km/h, preferably exceeding 15 km/h, can be achieved. Repositioning of the milling machine to a different operating site can be effected in a significantly shorter period of time which enables the overall operating efficiency of the milling machine to be improved significantly.

Figure 5:
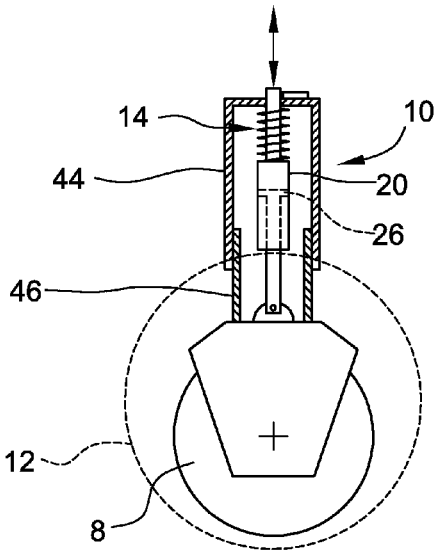
FIG. 5 is a schematic illustration of a mechanical spring device in travel mode.
Figure 6:
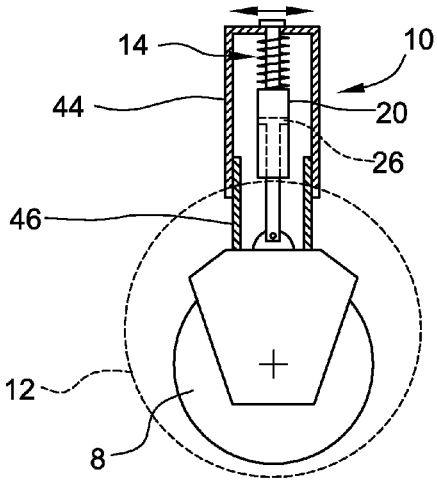
FIG. 6 is a schematic illustration of the mechanical spring device in working mode.

The spring device 14 may be a mechanical or a hydraulic spring device. In the event of a mechanical spring device 14 as seen in FIGS. 5 and 6, the same is arranged between the suspension unit 8 and the machine frame in line with the lifting column 10, with the spring device 14 being mechanically blocked as seen in FIG. 6 when the working drum performs a milling operation.

What is claimed is:

1. An automotive milling machine apparatus for the treatment of a road surface or ground surface, comprising:

a chassis including at least three ground engaging units for engaging the road surface or ground surface, the ground engaging units defining a front axis and a rear axis with reference to a direction of travel;

a machine frame supported by the chassis;

at least two lifting columns connected between two of the ground engaging units and the machine frame, said two of the ground engaging units being located on a common one of the axes and being transversely offset from one another with reference to the direction of travel;

a working drum supported from the machine frame for working the road surface or ground surface, the working drum being adjustable to a raised position out of engagement with the road surface or ground; and a spring system operatively associated with the at least two lifting columns and selectively operable when the working drum is in the raised position.

2. The apparatus of claim 1, wherein:

the spring system includes a mechanical spring.

3. The apparatus of claim 1, wherein:

the spring system includes a hydraulic spring.

4. The apparatus of claim 3, wherein:

the hydraulic spring comprises a diaphragm accumulator.

5. The apparatus of claim 3, wherein:

each lifting column includes a hydraulic piston-cylinder unit including a piston movable inside a cylinder, the piston dividing the cylinder into an upper cylinder chamber and a lower cylinder chamber.

6. The apparatus of claim 5, wherein:

the spring system includes at least one control valve connecting the upper cylinder chamber and the lower cylinder chamber to the hydraulic spring.

7. The apparatus of claim 6, wherein:

the spring system is configured such that the at least one control valve is closed in a working mode when the working drum is engaged with the road surface or ground surface, and the at least one control valve is operable to be opened in a travel mode when the lifting columns reach the pre-determined height of lift.

8. The apparatus of claim 1, wherein:

the spring system is configured such that the spring system is automatically operable upon the lifting columns reaching a pre-determined height of lift.

9. The apparatus of claim 1, wherein:

the at least two lifting columns are associated with the rear axis.

10. The apparatus of claim 1, wherein:

the spring system includes separate springs operatively associated with separate ones of the lifting columns.

11. The apparatus of claim 1, wherein:

the spring system includes a common spring operatively associated with all of the lifting columns.

12. The apparatus of claim 1, wherein:

the spring system is configured such that the spring system is blocked in a working mode when the working drum is engaged with the road surface or ground surface, and the spring system is operable to be activated in a travel mode when the working drum is in the raised position.

13. A method of using a milling machine to treat a road surface or a ground surface, the milling machine including a machine frame, a working drum, at least three ground engaging units for supporting the machine on the road surface or ground surface, at least two of the ground engaging units being transversely offset from each other on a front axis or rear axis, two lifting columns connected between the machine frame and the two transversely offset ground engaging units, each lifting column including a piston-cylinder unit, the method comprising:

(a) adjusting a distance between the machine frame and the road surface or ground surface, by adjusting the piston-cylinder units of the two lifting columns to move the frame between a lowered working mode and a raised travel mode, the working drum being out of engagement with the road surface or ground surface in the travel mode; and (b) coupling the two lifting columns to a spring when the machine is in the travel mode, and cushioning with the spring at least some shocks that occur during repositioning of the milling machine in the travel mode.

14. The method of claim 13, wherein:

step (b) further comprises connecting each of the piston-cylinder units to at least one hydraulic spring with at least one control valve.

15. A method of increasing an operating efficiency of a milling machine, the machine including a working drum for working a road surface or a ground surface, the method comprising:

(a) extending lifting columns of the machine and thereby raising the working drum to a raised position in which the working drum is disengaged from the road surface or ground surface;

(b) placing the machine in a travel mode, when the working drum is in the raised position, by coupling each of the lifting columns to a spring and disabling the working drum;

(c) with the machine in the travel mode, repositioning the machine to a new operating site at a travel speed; and (d) after reaching the new operating site, placing the machine in a working mode, by lowering the working drum into engagement with the road surface or ground surface, uncoupling each lifting column from the spring, and enabling the working drum so that the working drum can rotate to work the road surface or ground surface.

16. The method of claim 15, wherein:

in step (b), the spring is a mechanical spring.

17. The method of claim 15, wherein:

in step (b), the spring is a hydraulic spring.

18. The method of claim 17, wherein:

in step (b), each lifting column includes a piston-cylinder unit having cylinder chambers, and the hydraulic spring includes a diaphragm accumulator, and the coupling step comprises coupling the cylinder chambers to the diaphragm accumulator.

19. The method of claim 15, wherein:

step (b) further comprises automatically coupling each of the lifting columns to the spring upon reaching a predetermined height of lift; and step (d) further comprises automatically uncoupling each of the lifting columns from the spring upon falling below the predetermined height of lift.

* * * * *